US006477346B1

(12) United States Patent
Yahagi

(10) Patent No.: US 6,477,346 B1
(45) Date of Patent: Nov. 5, 2002

(54) IMAGE FORMING APPARATUS FEATURING A PLURALITY OF IMAGE BEARING MEMBERS ADJUSTABLE IN TWO DIMENSIONS

(75) Inventor: Takashi Yahagi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,706

(22) Filed: Nov. 28, 2000

(30) Foreign Application Priority Data

Nov. 30, 1999 (JP) ..... 11-338974
Nov. 24, 2000 (JP) ..... 2000-357404

(51) Int. Cl.[7] ..... G03G 15/00
(52) U.S. Cl. ..... 399/117
(58) Field of Search ..... 399/26, 107, 109, 399/111, 116, 117, 159, 167

(56) References Cited

U.S. PATENT DOCUMENTS 5,218,405 A * 6/1993 Wong ..... 399/117
5,745,825 A * 4/1998 Okawa et al. ..... 399/117
6,175,705 B1 * 1/2001 Harada et al. ..... 399/117
6,198,891 B1 * 3/2001 Ishida et al. ..... 399/117
6,249,661 B1 * 6/2001 Saito et al. ..... 399/117

FOREIGN PATENT DOCUMENTS

| | | |
|---|---|---|
| JP | 63-43173 | 2/1988 |
| JP | 8-87152 | 4/1996 |
| JP | 8-220972 | 8/1996 |

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An image forming apparatus including a first image bearing member for bearing an image thereon; a second image bearing member for bearing an image thereon; the images on the first image bearing member and the second image bearing member being sequentially superimposed and transferred to a transfer medium; and a supporting device for supporting each of the rotary shafts of the first image bearing member and the second image bearing member; the supporting device being provided with a first supporting member for supporting each of the rotary shafts for movement in a first direction, and a second supporting member for supporting each of the rotary shafts for movement in a second direction orthogonal to the first direction.

46 Claims, 14 Drawing Sheets

IMAGE FORMING APPARATUS FEATURING A PLURALITY OF IMAGE BEARING MEMBERS ADJUSTABLE IN TWO DIMENSIONS

BACKGROUND OF THE INVENTION

1. Field of the Invention

This invention relates to an image forming apparatus using the electrophotographic method, and for example, to an image forming apparatus such as a copier, a printer or a facsimile apparatus.

2. Related Background Art

As an image forming apparatus capable of polychromatic printing such as a color printer or a color copier, there has heretofore been proposed a color image forming apparatus which has a plurality of units (process cartridges) provided with at least photosensitive drums and detachably mountable to the main body of an image forming apparatus, and an exposure device for exposing each photosensitive drum charged in conformity with image information and forming an electrostatic latent image, and in which toner images of respective colors formed on the respective photosensitive drums are sequentially superimposed and primary-transferred to an intermediate transfer member, whereafter the toner images of respective colors on the intermediate transfer member are collectively secondary-transferred to a recording material.

Here, a bad image, i.e., an image having color misregistration, occurring when the disposed state of the photosensitive drums is inclined with respect to their regular position will be described with reference to a typical perspective view and a plan view shown in FIG. 12A, consisting of FIGS. 12A1 and 12A2, and 12B, consiting of FIGS. 12B1 and 12B2, respectively, of the accompanying drawings.

Consider a case where as shown in FIG. 12A, a photosensitive drum 501 is inclined by an amount of deviation $\Delta x$, i.e., an inclination a with respect to an ideal position (alternate long and two short dashes line) in a plane wherein photosensitive drums are juxtaposed. When a laser beam based on image information is scanned on this photosensitive drum 501 by an exposure device, the photosensitive drum is exposed as indicated by a heavy line L(Exp), and at a transfer position, as indicated by a heavy line L(Tr), an amount of deviation $2\Delta x$, i.e., an image transferred from the photosensitive drum onto an intermediate transfer member 502, becomes inclined by $2\alpha$ which is double the aforementioned inclination $\alpha$. Further, if the inclinations of a plurality of photosensitive drums differ from one another, the inclinations of the images transferred onto the intermediate transfer member 502 also differ from one another and the positions of the toner images of respective colors on the intermediate transfer member 502 do not become coincident with one another within an allowable range, and become color misregistration or color irregularity.

Also, when as shown in FIG. 12B, the length of the optical path from an exposure device (laser deflector) to the surface of the photosensitive drum 501 differs between the scanning starting side (one lengthwise end side of the photosensitive drum) and the scanning ending side (the other lengthwise end side of the photosensitive drum), even if the light emission timing of the laser beam is controlled to thereby conform the exposure starting positions of the laser beams of respective colors to one another and a modulation frequency for effecting the light modulation of the laser beams is changed to thereby make general magnifications (the width of the image and the width in the main scanning direction) coincident with each other, the inclination $\beta$ of the photosensitive drum 501 with respect to the exposure direction leaves an amount of deviation $\Delta z$ at the intermediate position of the image and appears as color misregistration. So, in order to eliminate these inclinations $\alpha$ and $\beta$, that is, to eliminate the amounts of deviation $\Delta x$ and $\Delta y$ relative to the regular position of the photosensitive drum, it is necessary to accurately determine the position at which each photosensitive drum is disposed.

So, heretofore, in order to accurately position the plurality of photosensitive drums 501 in the main body of the image forming apparatus, there has been adopted a method as shown in FIG. 13 of the accompanying drawings wherein the rotary shaft portions 511 of the plurality of photosensitive drums 501 are accurately fixed and supported in engagement holes 604 disposed in a common centering plate 601 comprising a single member, and the reference apertures 602A and 602B of the common centering plate 601 are fitted to positioning pins 603A and 603B provided on a front side plate 600 constituting the frame of the main body of the image forming apparatus to thereby accurately position the photosensitive drums.

In the above-described construction according to the prior art, however, the plurality of photosensitive drums 501 are accurately positioned by the common centering plate 601 which is a single member and therefore, high dimensional accuracy has been required when the engagement holes 604 are formed in the common centering plate 601.

Further, when each photosensitive drum 501 (or process cartridge) is to be interchanged, it is necessary to once detach the common centering plate 601, and in case of the assembly after the interchange, the shaft portions 511 of the plurality of photosensitive drums must be engaged with the engagement holes 604 in the common centering plate 601 at a time, and this has been a factor which makes the work of interchanging the photosensitive drums 501, etc. difficult. Likewise, in the manufacturing process of the image forming apparatus, it has been a factor which makes the assembling work for the photosensitive drum difficult.

SUMMARY OF THE INVENTION

It is an object of the present invention to provide an image forming apparatus in which the position of each rotary shaft or each bearing of a first image bearing member and a second image bearing member can be adjusted easily.

It is another object of the present invention to provide an image forming apparatus in which the position of each protruding portion provided on a first unit and a second unit can be adjusted easily.

Further objects of the present invention will become apparent by reading the following detailed description.

DESCRIPTION OF THE PREFERRED EMBODIMENTS

Figure 1:
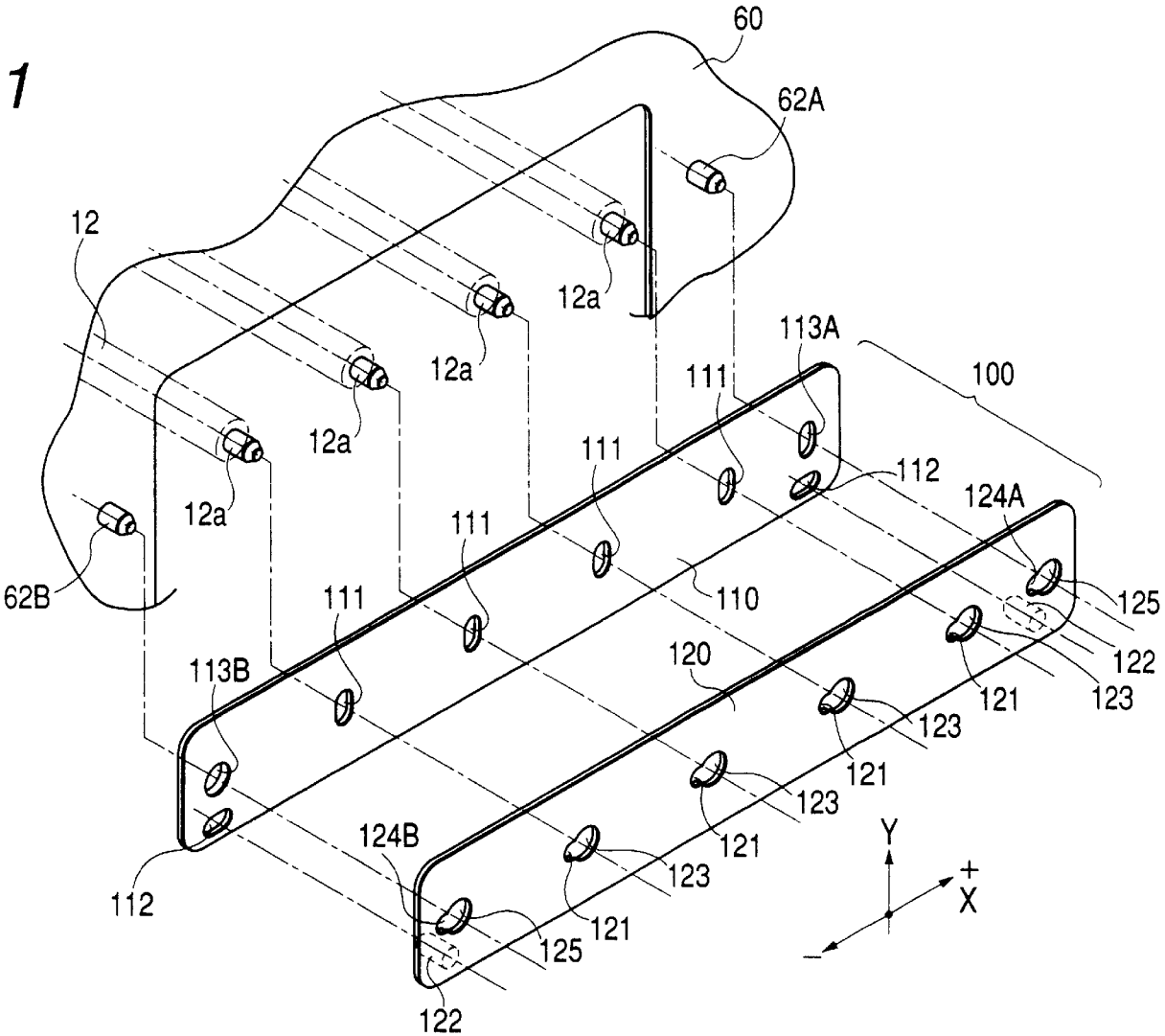
FIG. 1 is a typical perspective view showing the relations among a front side plate, a centering plate and a photosensitive drum in an image forming apparatus according to a first embodiment of the present invention.

Some embodiments of an image forming apparatus to which the present invention is applied will hereinafter be described in detail with reference to the drawings. In the following embodiments, an image forming apparatus of the electrophotographic type capable of effecting full color image formation is shown by way of example.

First Embodiment

An image forming apparatus according to a first embodiment of the present invention will hereinafter be described in detail with reference to FIGS. 1 and 2. The construction of the color image forming apparatus according to the present embodiment will first be schematically described with reference to FIG. 2. FIG. 2 is a typical cross-sectional view schematically showing the construction of the full color image forming apparatus according to the first embodiment.

As shown in FIG. 2, the color image forming apparatus according to the present embodiment is provided with process cartridges 10Y, 10M, 10C and 10K, and toner cartridges 16Y, 16M, 16C and 16K corresponding to four colors (Y: yellow, M: magenta, C: cyan and K: black). Each process cartridge is detachably mountable on this side of FIG. 2 (along an axial direction of the rotary shaft of each photosensitive drum).

The process cartridges 10Y, 10M, 10C and 10K are of the same structure, and photosensitive drums (electrophotographic photosensitive members) 12 which are image bearing members, and as process means for acting thereon, charging means 13 for charging the surfaces of the photosensitive drums, developing means 14 for developing latent images formed on the photosensitive drums, and cleaning means 15 for removing developers residual on the photosensitive drums are integrally constructed.

Likewise, the toner cartridges 16Y, 16M, 16C and 16K are of the same structure, and each of them is comprised of a toner containing portion 17 in which a toner is contained, and a toner supplying screw 18 for supplying the developing means 14 with the toner in the toner containing portion 17 when a toner supply signal is sent by the toner amount detecting means, not shown, of the developing means 14.

Further, the color image forming apparatus according to the present embodiment is provided with exposing means 20Y, 20M, 20C and 20K for applying a laser beam conforming to the image information of an original to the surfaces of the photosensitive drums 12 charged by the charging means 13, an intermediate transfer member unit 30, a recording material conveying unit 40 and a fixing unit 50, besides the aforementioned process cartridges and toner cartridges.

The intermediate transfer member unit 30 is provided with an intermediate transfer belt 31 (intermediate transfer member) as a transfer medium, three rollers 32, 33 and 34 rotatably supporting the intermediate transfer belt 31, four primary transfer means 35 for sequentially superimposing and primary-transferring toner images of respective colors formed on the photosensitive drums 12 onto the intermediate transfer belt 31, secondary transfer means 36 for secondary-transferring the toner images transferred onto the intermediate transfer belt 31 further to a recording material P, and intermediate transfer member cleaning means 19 for collecting residual toners on the intermediate transfer belt 31.

The recording material conveying unit 40 is provided with a pickup roller 43 for conveying the recording material P from a feed cassette 41 to a secondary transfer area, feed rollers 44, conveying rollers 45 and registration rollers 46 for feeding out the recording material P in synchronism with the toner image on the drum.

The fixing unit 50 i s provided with a fixing roller 51 and a pressure roller 52, and applies heat and pressure to the toner image to thereby fix the toner image on the recording material P.

In the above-described construction, in the process cartridge 10Y of the first color, e.g. yellow, the photosensitive drum 12 is uniformly charged by the charging means 13, whereafter a latent image is formed by a laser beam applied from the exposing means 20Y, and this latent image is developed by the developing means 14, whereby a toner image is formed.

The toner image formed on the photosensitive drum 12 is primary-transferred onto the intermediate transfer belt 31 by the action of the primary transfer means 35. After the termination of the primary transfer, the photosensitive drum 12 is cleaned by the cleaning means 15 and is used for the next image formation.

A similar image forming process is also carried out in each of the process cartridges 10M, 10C and 10K for M, C and K, whereby toner images of the respective colors are formed and are sequentially superimposed on the previously formed toner image and transferred.

On the other hand, the recording material P is conveyed from the feed cassette 41 to the secondary transfer area by the recording material conveying unit 40, and the toner images of the respective colors formed on the intermediate transfer belt 31 are secondary-transferred to the recording material P by the action of the secondary transfer means 36. The recording material P to which the toner images have been transferred is conveyed to the fixing unit 50, and the toner images thereon are fixed in the nip portion between the fixing roller 51 and pressure roller 52 of the fixing unit 50, and the recording material P is discharged onto a discharge tray 56 by discharge rollers 55.

While in the image forming apparatus shown in FIG. 2, the feed cassette 41 is comprised of a single stage, this is not restrictive, but for example, a plurality of stages may be disposed so that recording materials differing in size or stacking orientation may be contained and desired recording materials can be suitably selected.

Figure 2:
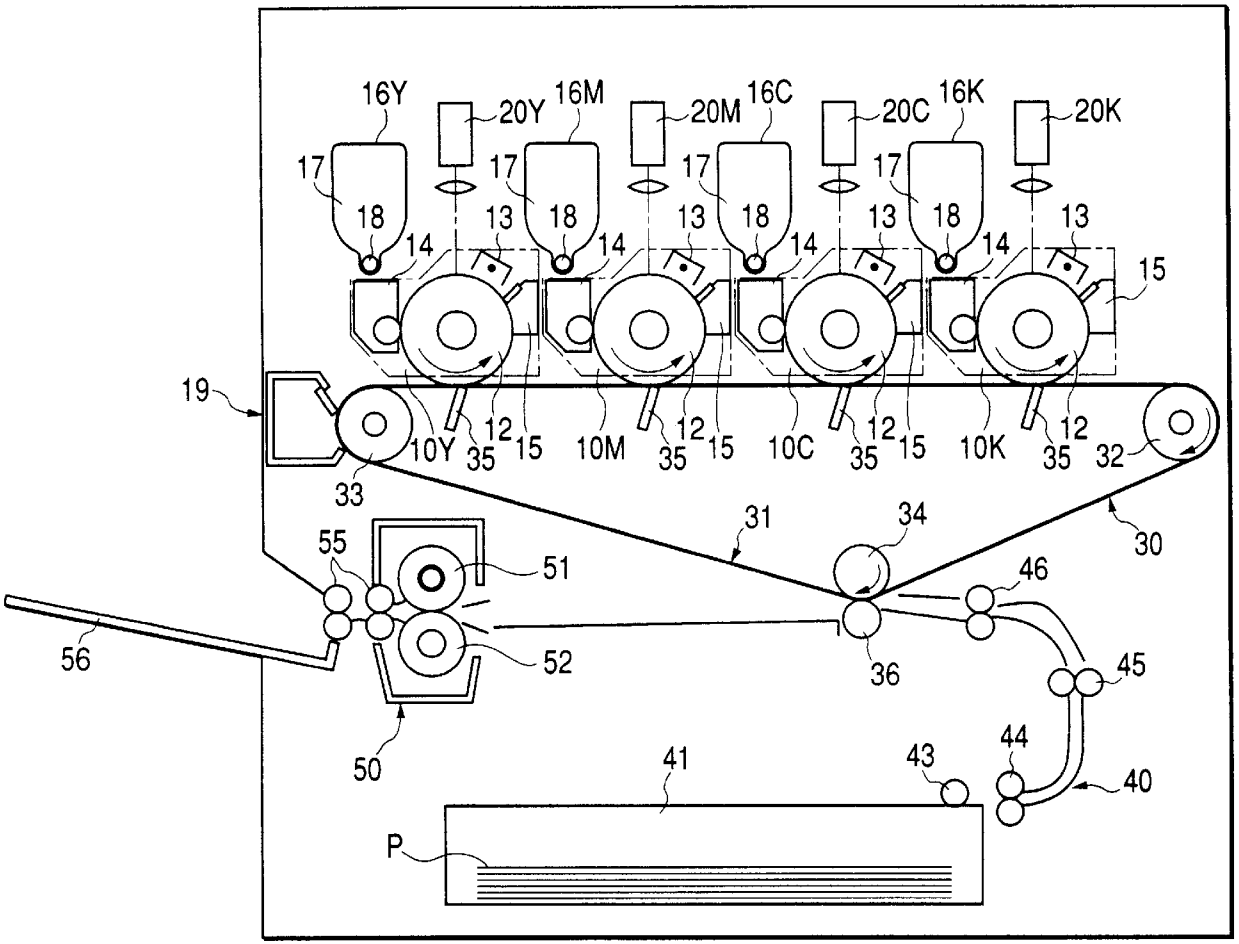
FIG. 2 is a typical cross-sectional view of a color image forming apparatus to which the present invention is applicable.

Reference is now had to FIG. 1 to describe the relations among a front side plate 60 (disposed on the front side of the image forming apparatus) which is a first side plate constituting the apparatus main body frame in the color image forming apparatus according to the present invention, a centering plate 100 as supporting means supporting the rotary shafts of the photosensitive drums 12 mounted on the front side plate 60, and the photosensitive drums 12 in the respective process cartridges. FIG. 1 is a typical perspective view showing the relations among the front side plate, the centering plate and the photosensitive drums.

As shown in FIG. 1, the centering plate 100 supporting and positioning one end side of the rotary shaft 12*a* of such photosensitive drum 12 is designed to be positioned on and fixed to the front side plate 60. This centering plate 100 has a X determining plate 110 as a first regulating member for supporting each rotary shaft 12*a* for movement in the direction of arrow Y which is the direction of movement (the direction of a straight line linking the primary transfer portions together) of the transfer surface of the intermediate transfer belt on which the primary transfer is effected and also regulating (positioning) the position of each rotary shaft 12*a* in the direction of arrow X, and a Y determining plate 120 as a second regulating member for supporting each rotary shaft 12*a* for movement in the direction of arrow X which is a direction orthogonal to the regulating direction (the direction of arrow X) of the X determining plate 110 and also regulating (positioning) the position of each rotary shaft 12*a* in the direction of arrow Y. That is, even if the position of each rotary shaft 12*a* in the X direction is adjusted by the X determining plate, the position of each rotary shaft 12*a* in the regulating direction by the Y determining plate, i.e., the position of each rotary shaft 12*a* in the Y direction, is affected in no way and therefore, the working property when each photosensitive drum is assembled can be improved.

Also, the other end side of each rotary shaft 12*a* is supported and fixedly positioned on a rear side plate (disposed on the rear side of the image forming apparatus) which is a second side plate constituting the apparatus main body frame.

The X determining plate 110 is formed with holding apertures 111 for movably supporting the rotary shafts 12*a* of the respective photosensitive drums 12. The length of each holding aperture 111 in the X direction is set so as to be substantially equal to the diameter (in the present embodiment, 13 mm) of each rotary shaft 12*a* or slightly greater (e.g. by several tens of $\mu$m) than the aforementioned diameter with the assembly taken into account.

Also, the Y determining plate 120 is formed with holding apertures 121 (in the present embodiment, having a length of 13 mm in the Y direction and a length of 5 mm in the X direction) for movably supporting the rotary shafts 12*a* of the respective photosensitive drums 12. Further, widened portions 123 (in the present embodiment, having a length of 17 mm in the Y direction and a length of 23 mm in the X direction) having their width sufficiently widened in the direction of arrow Y than the-diameter of each rotary shaft 12*a* are coupled to the holding apertures 121 formed in the Y determining plate 120 (the length of the apertures in the X direction is set to 28 mm in total). The length of each holding aperture 121 in the Y direction is set so as to be substantially equal to the diameter of each rotary shaft 12 or slightly greater (e.g. by several tens of $\mu$m) than the aforementioned diameter with the assembly taken into account.

Here, the Y determining plate 120 is regulated in the direction of arrow Y relative to the X determining plate 110 and supported for movement in the direction of arrow X by pins 122 disposed on the Y determining plate 120 and fitting apertures 112 formed in the X determining plate 110.

Further, the X determining plate 110 is formed with a reference aperture 113A fitted on in reference pin 62A disposed near the opening portion of the front side plate 60, and an aperture 113B of a sufficient size to pass therethrough a reference pin 62B disposed near the opening portion of the front side plate 60. Also, the Y determining plate 120 is formed with reference apertures 124A and 124B in which the reference pins 62A and 62B of the front side plate 60 are fitted. Each of the reference apertures 124A and 124B in the Y determining plate 120 has a widened portion 125 similar to that of each holding aperture 121.

The centering plate 100 constructed as described above is engaged with the reference pins 62A, 62B disposed on the front side plate 60 and the reference apertures 113A, 124A and 124B formed in the X determining plate 110 and the Y determining plate 120. Thus, the centering plate 100 is positioned and held relative to the front side plate.

The mounting operation will now be described. Before the centering plate 100 is mounted, the Y determining plate 120 is drawn in the negative direction of arrow X (the minus (−) direction in FIG. 1) relative to the X determining plate 110. The centering plate 100 is mounted on the front side plate 60 so that each holding aperture formed in the X determining plate 110 and the rotary shaft 12*a* of each photosensitive drum 12 may be fitted together and the reference aperture 113A and the reference pin 62A may be fitted together. At this time, the rotary shaft 12*a* of each photosensitive drum 12 extends through the widened portion 123 of each holding aperture 121 formed in the Y determining plate 120. After the centering plate 100 has been mounted on the front side plate 60, the Y determining plate 120 is moved in the positive direction of arrow X (the plus (+) direction in FIG. 1). Thereupon, each holding aperture 121 formed in the Y determining plate 120 and the rotary shaft 12*a* of each photosensitive drum 12 are fitted together and the reference aperture 124A and the reference pin 62A are fitted together and the reference aperture 124B and the reference pin 62B are fitted together.

As described above, the reference apertures 113A, 124A, 124B and the reference pins 62A, 62B are fitted together and the positions of the rotary shafts 12*a* in the directions of arrows X and Y are individually positioned and therefore, it becomes unnecessary to determine the direction of arrow X and the direction of arrow Y at a time as in the conventional art, and the mounting can be accomplished easily.

Also, the angle formed between the respective directions in which the X determining plate 110 and the Y determining plate 120 movably support the shafts 12*a* of the photosensitive drums 12 are about 90°, whereby the accuracy of one part is prevented from affecting that of the other. Therefore, even if for example, an adjusting mechanism capable of adjusting the rotary shafts of the photosensitive drums in the direction of arrow X is provided on the X determining plate 110 so as to effect adjustment, no influence is given in the direction of arrow Y substantially orthogonal thereto.

Here, if the design is made such that the direction for adjusting the distance (the length of the optical path) between each exposing means and each photosensitive drum 12 is made coincident with the aforedescribed direction of arrow Y so as to form 90° with respect to the direction of movement of the intermediate transfer belt, no influence is given to the other (the direction of arrow X) when as previously described, the position of each photosensitive drum 12 is adjusted in the exposure direction (adjusted in the direction of arrow Y), and it becomes possible to position each photosensitive drum 12 accurately. Also, when regarding the positioning accuracy of the photosensitive drums 12, the required accuracy differs between the direction of arrow X and the direction of arrow Y, the dimensional error (positioning accuracy) of one does not affect the positioning accuracy of the other as described above and therefore, the dimensional accuracy of the X determining plate 110 and the dimensional accuracy of the Y determining plate 120 can be prepared at desired dimensional accuracy independently of each other.

Also, while in the present embodiment, the single body of the photosensitive drum has been shown and described, a process cartridge construction including the photosensitive drum may be adopted and be made integral for example, with a developing device which is developing means. In the process cartridge containing the photosensitive drum therein, the shaft of the photosensitive drum is protruded as a protruding portion, and this protruding portion is supported by the centering plate 100 comprising the X determining plate 110 and the Y determining plate 120 described in the present embodiment. If this is done, the present invention is also applicable to a color image forming apparatus adopting the process cartridge construction including photosensitive drums.

Also, the above-described example in which the rotary shafts of the photosensitive drums are directly supported by the centering plate 100 is not restrictive, but a construction in which, for example, a bearing 12*a*' (FIG. 7) receiving each rotary shaft is provided and each bearing 12*a*' is supported by the centering plate 100 may be adopted.

Here, what constitutes the process cartridge is not limited to a developing device which is developing means as process means for acting on the photosensitive drum, but may be a charger which is charging means, or a cleaner which is cleaning means for removing any developer residual on the photosensitive drum, or further may include two or more of these process means.

The aforedescribed protruding portion is not restricted to a construction in which the shaft of the photosensitive drum is protruded, but may also be a construction in which the shaft of the photosensitive drum is contained in the process cartridges and a protruding portion protruding outwardly of the frame of the process cartridge is discretely provided and this protruding portion is positioned and supported by the X determining plate 110 and the Y determining plate 120 to thereby position and support the shaft of the photosensitive drum. In order to prevent the frame from being rotated and inclined when the protruding portion is supported by the X determining plate 110 and the Y determining plate 120, it is preferable to provide the protruding portion near the position of the center of gravity of the frame. It is more preferable to provide the protruding portion on the frame so as to be located on the extension of (coaxially with) the shaft of the photosensitive drum. This is because even if the frame is rotated and inclined when the protruding portion is supported by the X determining plate 110 and the Y determining plate 120, the relation between the photosensitive drum and the light scanning direction by the exposing means is affected in no way.

Second Embodiment

Figure 3:
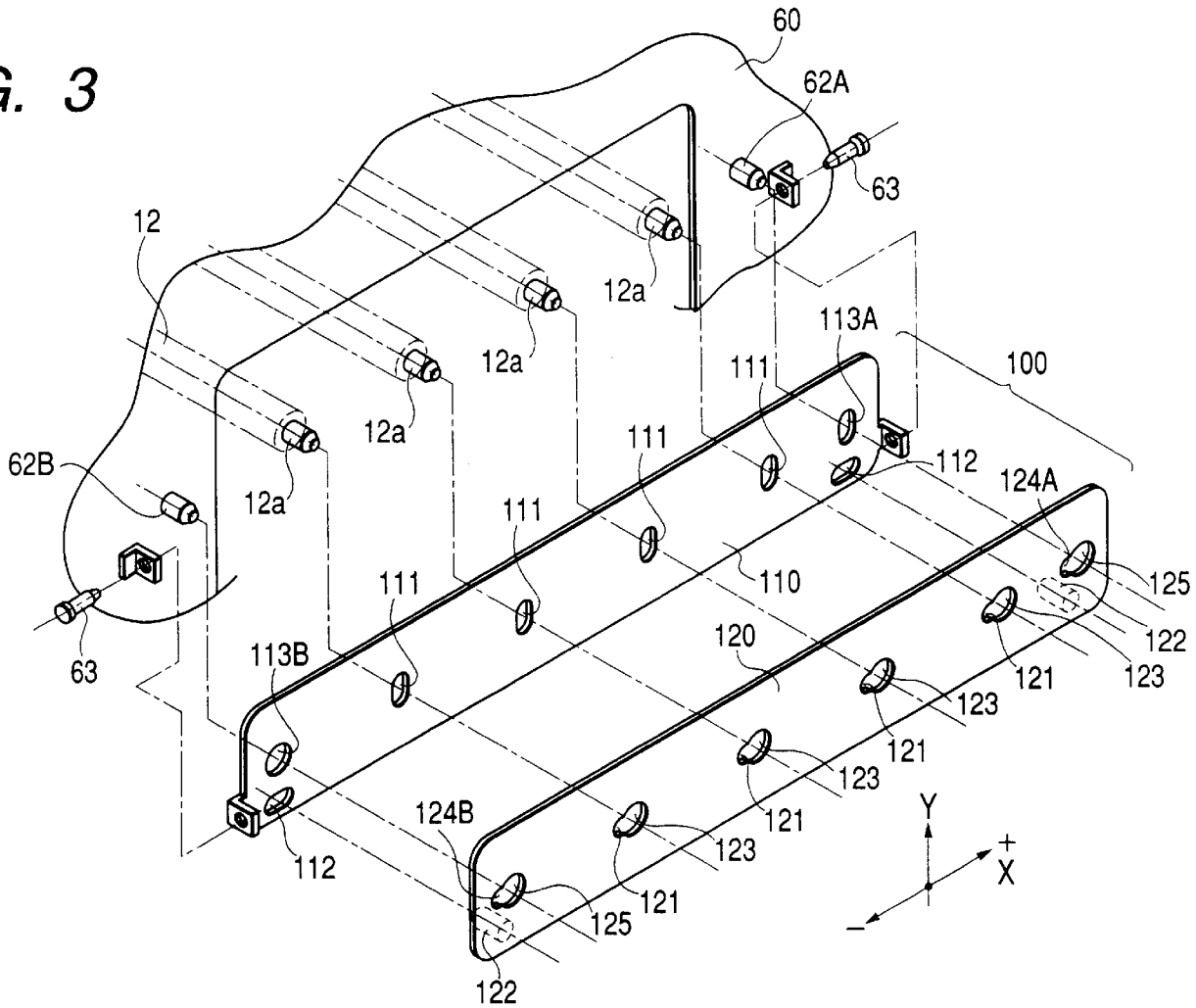
FIG. 3 is a typical perspective view showing the relations among a front side plate, a centering plate and a photosensitive drum in an image forming apparatus according to a second embodiment of the present invention.

An image forming apparatus according to a second embodiment of the present invention will now be described in detail with reference to FIGS. 3 to 5A and 5B. FIG. 3 is a typical perspective view showing the relations among a front side plate, a centering plate and photosensitive drums in the image forming apparatus according to the present embodiment. The schematic construction of the entire image forming apparatus is substantially the same as that of the aforedescribed embodiment and therefore, description will be made here of the relations among the front side plate 60, the centering plate 100 and the photosensitive drums 12 which are the characteristic portions of the present embodiment.

As shown in FIG. 3, provision is made of an openable and closable door unit 400 having an X deterning plate and a Y determining plate integrally with each other and enabling each photosensitive drum to be detachably mounted to the main body of the image forming apparatus (for forming a space for mounting and dismounting). Particularly, the X determining plate 110 is pivotally supported relative to the front side plate 60 by hinge pins 63 which are the pivotal movement center axis, and is designed to be openable and closable with the Y determining plate 120. The hinge pins 63 are disposed parallel with the direction of movement of the Y determining plate 120 (the direction of arrow X). In order to avoid interference when the centering plate 100 is positioned on the front side plate 60, it is preferable that the engagement portions of the hinge pins 63 be provided with more or less play (in the present embodiment), the order of 0.1 to 1 mm) in the direction of arrow Y. It is also preferable that more or less play (in the present embodiment, the order of 0.5 mm) be provided in the direction of arrow X.

Figure 4:
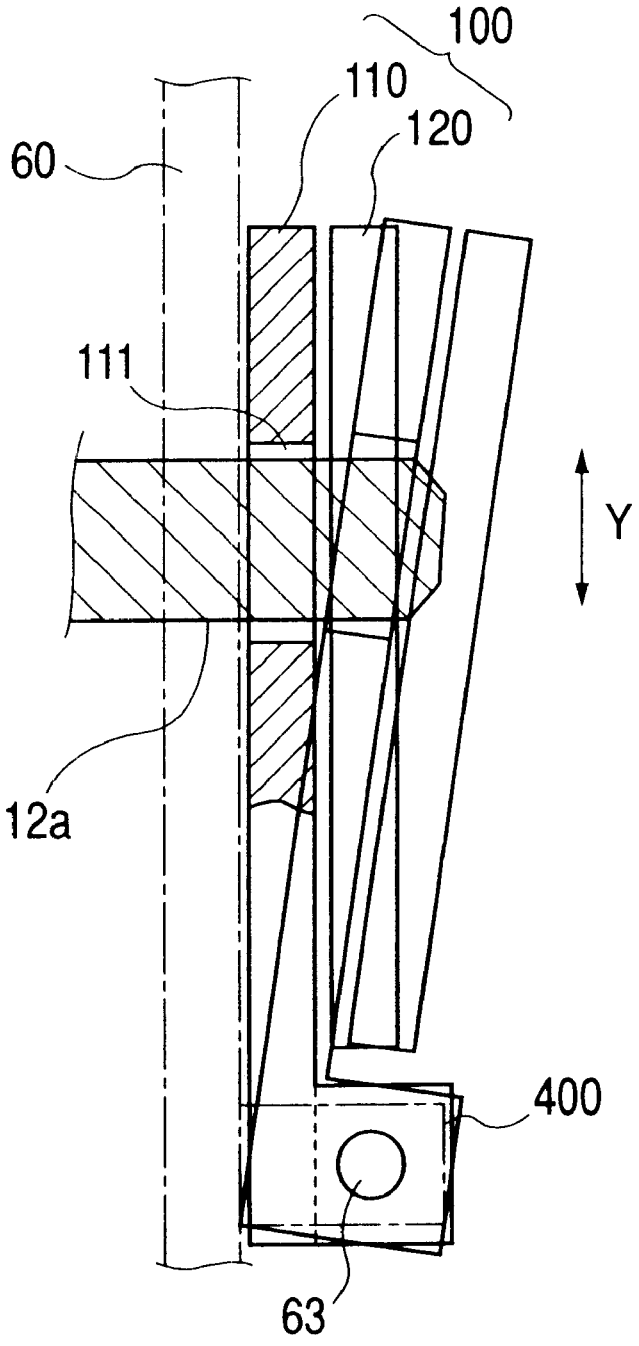
FIG. 4 is a typical cross-sectional view showing the relations among the front side plate, the centering plate and the photosensitive drum in the image forming apparatus according to the second embodiment.

FIG. 4 is a typical side view of the centering plate 100, and heavy lines indicate the state when the X determining plate 110 and the Y deterning plate 120 have been integrally pivotally move by about 10° relative to the front side plate 60. As shown in FIG. 4, the centering plate 100 is pivotally movable about the hinge pins 63. As previously described, the holding apertures 111 provided in the X determining plate 110 are formed sufficiently larger in the direction of arrow Y than the diameter of the rotary shaft 12*a* of each photosensitive drum 12 and therefore, during the pivotal movement, these holding apertures 111 function as the relieved portions of the respective rotary shafts 12*a*, and as shown in FIG. 4, the holding apertures 111 and the rotary shafts 12*a* do not interfere with each other to hamper the pivotal movement (the opening and closing movement) of the centering plate 100. Also, before the centering plate 100 is pivotally moved, the Y determining plate 120 is moved in the direction of arrow X (see FIG. 3) so that each rotary shaft 12*a* may be supported by each widened portion 123. By the Y determining plate 120 being thus moved, the widened portion 123 functions as the relieved portion of each rotary shaft 12*a*, and each rotary shaft 12*a* does not interfere with each holding aperture 121. The design is made such that in a state wherein each rotary shaft 12*a* is supported and regulated by the centering plate, each rotary shaft 12*a* protrudes by 4 mm outwardly from the aperture in the Y determining plate (protrudes rightwardly as viewed in FIG. 4) in order to be firmly held by the aperture portion of the Y determining plate.

The centering plate 100 is divided into and comprised of two members, i.e., the X determining plate 110 and the Y determining plate 120, and the hinge pins 63 are disposed parallel to the direction of movement of the Y determining plate 120 (the direction of arrow X), whereby it becomes possible to effect the opening and closing of the centering plate 100 without spacing it apart from the front side plate 60.

By thus constructing the centering plate 100, the centering plate 100 is positioned within a certain predetermined range restrained by the hinge pins 63, and it becomes possible to effect the engagement between the reference pins 62A, 62B disposed on the front side plate 60 and the reference apertures 113A, 124A, 124B in the centering plate 100 easily.

Figure 5B:
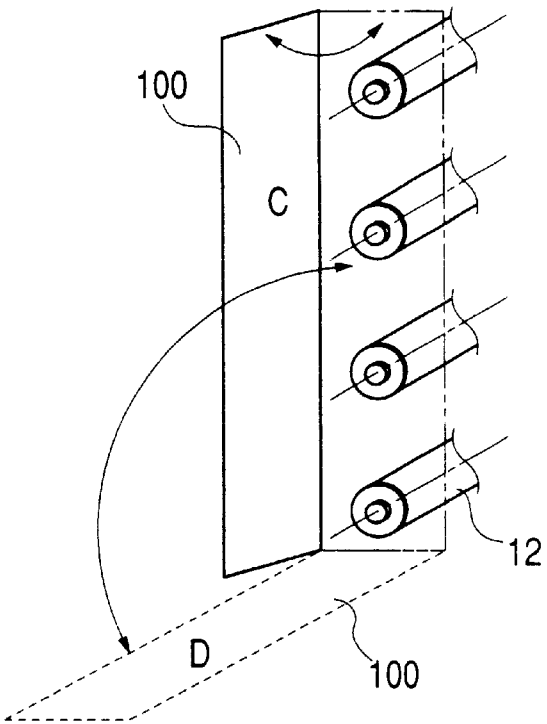
FIGS. 5A and 5B are typical cross-sectional views illustrating another opening and closing operation construction for the centering plate.
Figure 5A:
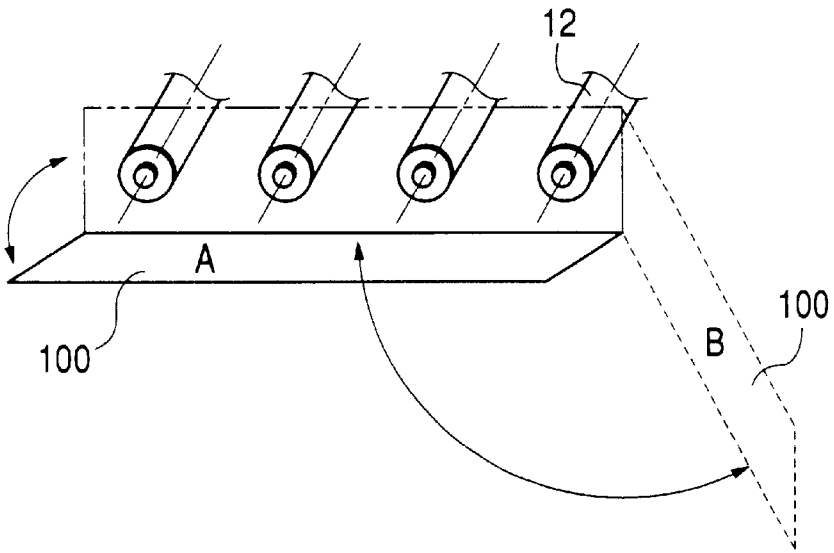

While in the present embodiment, as regards the direction of pivotal movement of the centering plate 100, the opening and closing operation has been performed as indicated by A in FIG. 5A typically showing the opening and closing operation, a laterally opening construction may be adopted as indicated by B in FIG. 5A. In that case, the widened portions 123 can be disposed in accordance with the axial direction of the hinge pins 63. Also, while in the present embodiment, an image forming apparatus in which a plurality of photosensitive drums 12 are disposed in a horizontal direction (the direction of arrow X in FIG. 3) has been shown by way of example, there may be adopted a construction in which the photosensitive drums are disposed in a vertical direction (the direction of arrow Y in FIG. 3) and further the hinge pins 63 are suitably disposed so that the opening and closing operation may be performed as indicated by C or D in FIG. 5B.

While in the above-described first and second embodiments, positioning is effected with the X determining plate 110 and the Y determining plate 120 fitted to the reference pins 62A and 62B disposed on the front side plate 60, the X determining plate 110 and the Y determining plate 120 may be positioned with discrete positioning reference pins provided.

Also, while in the above-described first and second embodiments, description has been made of an example in which the widened portions 123, 125 are disposed in the Y determining plate 120, the X determining plate 110 and the Y determining plate 120 may be made separable from each other and the widened portions may be eliminated, or the widened portions may also be provided in the X determining plate 110.

Also, while in the above-described first and second embodiments, the fitting between the Y determining plate 120 and the shafts 12*a* of the photosensitive drums has been described with respect to an example in which the holding apertures 121 and the widened portions 123 formed in the Y determining plate 120 are used, there may be adopted a construction in which the fitting is effected with the left and right reversed to thereby effect positioning.

Also, while in the above-described first and second embodiments, the design is made such that the positional relation between the X determining plate 110 and the Y determining plate 120 is established by the pins 122 and the fitting apertures 112, this is not restrictive, but the following construction may be adopted.

For example, there may be adopted a construction in which the pins 122 are eliminated and the pins 62A and 62B are further extended and by these, both of the X determining plate 110 and the Y determining plate 120 are supported and positioned.

Also, the centering plate 100 may be constructed with the Y determining plate 120 held in its floated state relative to the X determining plate 110 so that the reference apertures 124A, 124B of the Y determining plate 120 and the reference pins 62A, 62B may be fitted together.

Describing with reference to FIG. 3, the play of the fitting between the fitting apertures of the X determining plate 110 and the pins 122 of the Y determining plate is made greater than in the case of the first and second embodiments and instead, the play of the fitting of the hinge pins 63 is made smaller to a certain extent than in the case of the second embodiment, whereby the centering plate 100 can be constructed without the opening and closing operation being made difficult to perform.

Here, even if there is some play in the fitting of the hinge pins 63, the deviation of the X determining plate 110 in the Y direction does not affect the positional accuracy of each rotary shaft 12*a* in the Y direction (because the accuracy is maintained by the Y determining plate) and the Y determining plate 120 is positioned by the reference pins 62A, 62B and therefore, the position of each rotary shaft 12*a* in the Y direction can be determined accurately.

If the play of the fitting of the hinge pins 63 is extremely great, the direction in which the X determining plate 110 and the Y determining plate 120 support and regulate the rotary shafts 12*a* will deviate, and if this deviation is great, a reduction in the positioning accuracy of the drums will result and therefore, it is desirable that the play be of the order of 0.1 to 1 mm.

Figure 7:
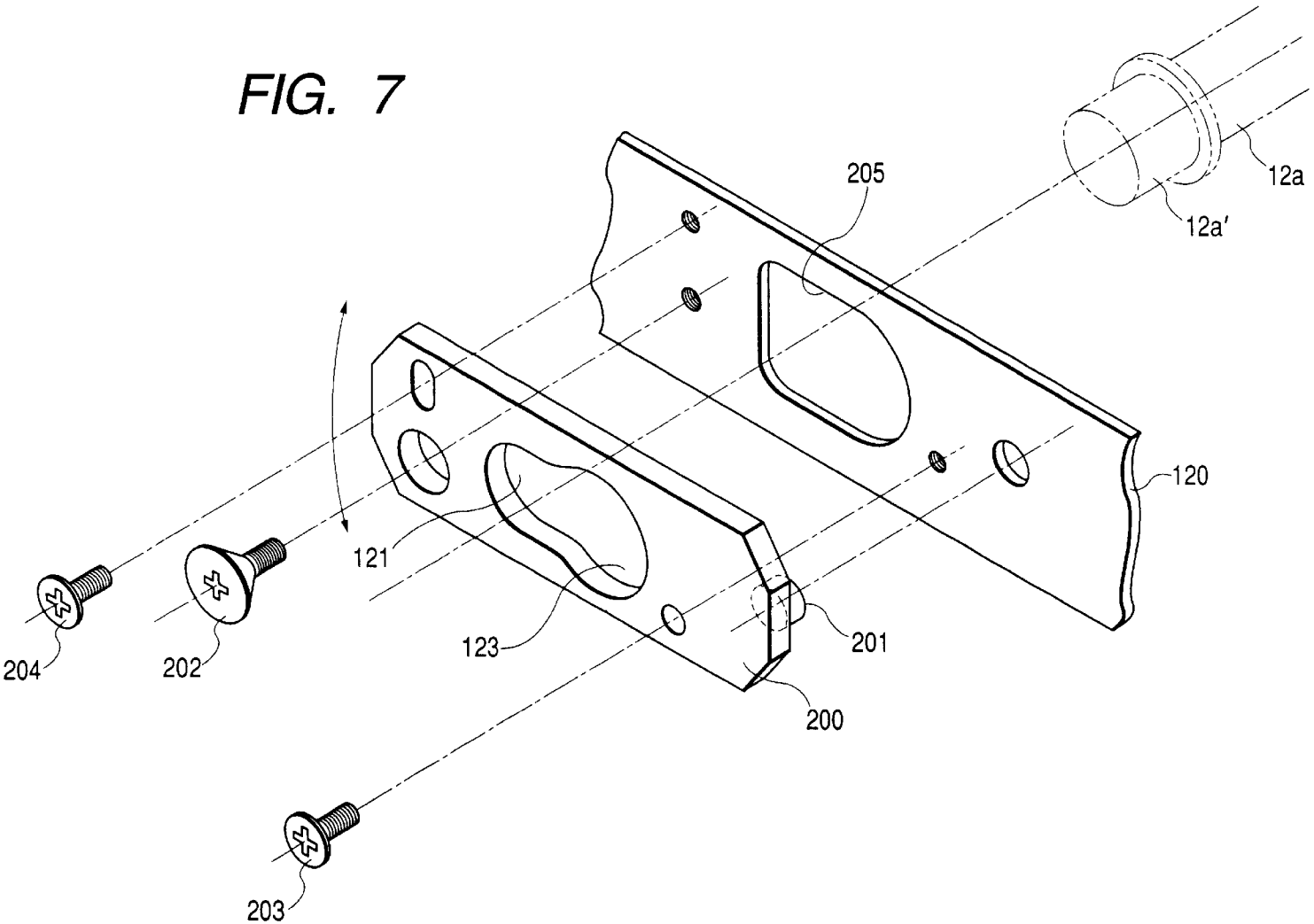
FIG. 7 illustrates a Y-axis adjusting mount provided on a Y determining plate.
Figure 8:
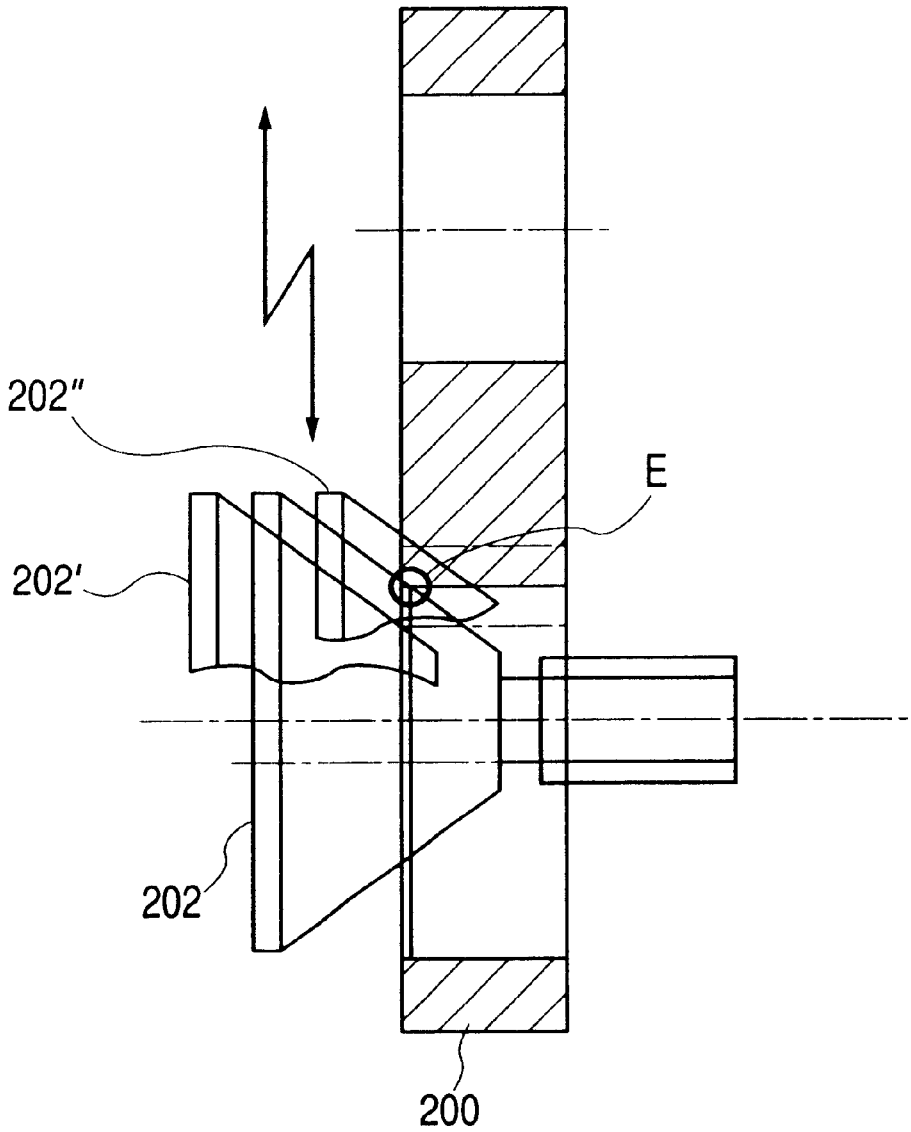
FIG. 8 is a cross-sectional view illustrating the Y-axis adjusting mount.

Also, the following construction may be added to the construction of the first and second embodiments. That is, as shown in FIG. 7, an aperture 205 in the Y determining plate 120 for supporting each rotary shaft 120 may be made larger than in the above-described embodiments, and an adjusting mechanism capable of adjusting the positions of the rotary shafts 12*a* in the Y direction independently of one another may be provided in this portion. A Y-axis adjusting mount 200 is fixed by screws 203 and 204 so as to be pivotally movable about the center of pivotal movement 201 relative to the Y determining plate 120. The Y-axis adjusting mount 200, as in the first and second embodiments, is formed with aperture portions 121 and 123 for movably supporting the rotary shafts 12*a*, and by rotating a tapered pin 202 and pushing the tapered pin 202 toward the Y-axis adjusting mount 200 (a state indicated by 202" in FIG. 8) or pulling out the tapered pin 202 (a state indicated by 202' in FIG. 8), the Y-axis adjusting mount 200 is made pivotally movable in the direction of arrow in FIG. 7. Describing this in detail with reference to FIG. 8, when the tapered pin is rotated and pushed in (pushed in rightwardly as viewed in FIG. 8), the tapered portion of the tapered pin pushes up the E portion of the Y-axis adjusting mount. Also, when the tapered pin is rotated and pulled out (pulled out leftwardly as viewed in FIG. 8), the E portion of the Y-axis adjusting mount lowers by the gravity of the photosensitive drum.

Here, the Y-axis adjusting mount 200 is pivotally moved, but the position of each rotary shaft 12*a* in the X direction is regulated by the X determining plate 110 and therefore, even if the position of each rotary shaft 12*a* in the Y direction is adjusted by the Y-axis adjusting mount 200, the position of each rotary shaft 12*a* will not fluctuated.

By adopting such a construction, the position of each rotary shaft 12*a* in the Y direction can be determined more accurately.

Figure 9:
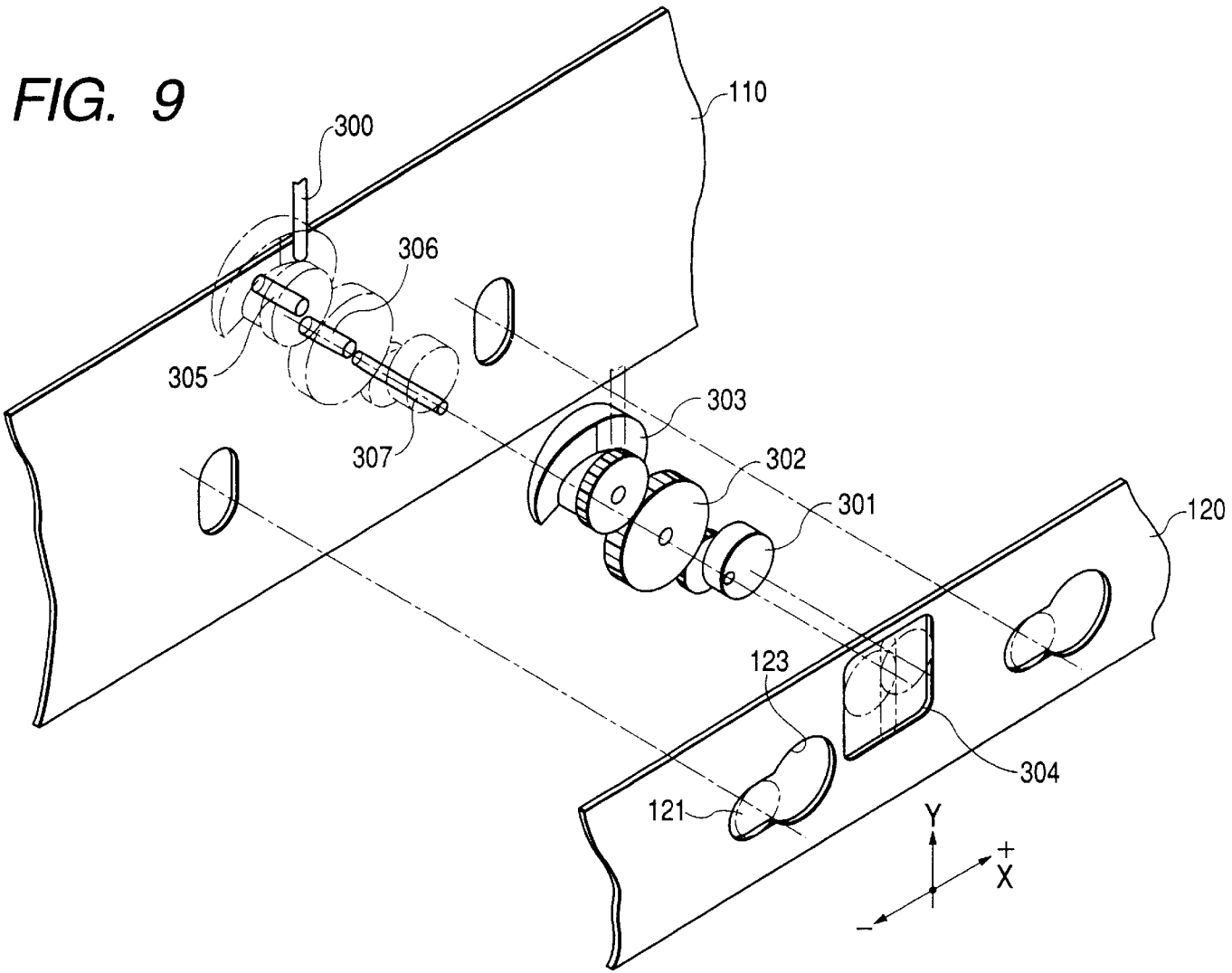
FIG. 9 illustrates an opening and closing mechanism for the centering plate.

Also, as shown in FIG. 9, provision may be made of a moving mechanism for moving the Y determining plate 120 in the direction of arrow X before the centering plate 100 (operable and closable door unit 400) is pivotally moved. Describing in detail, an eccentric cam gear 301, a handle gear 302 and a lead cam gear 303 are assembled about shafts 307, 306 and 305, respectively. The eccentric cam gear 301 is comprised of a gear and a circular cam offset by 5 mm from the center of rotation, and when the handle gear is rotated, the eccentric cam gear is rotated by 180° and the circular can pushes the cam follower aperture 304 of the Y determining plate, which is thus moved by 10 mm in the minus (–) X direction. At this time, the lead cam gear meshing with the handle gear is also designed to be rotated by about 90°, and in the present embodiment, a handle-shaped member 310 is provided on the handle gear, and by rotating this handle by 90°, the movement of the Y determining plate in the minus (–) X direction and the rotation of the lead cam gear can be accomplished.

Figure 10C:
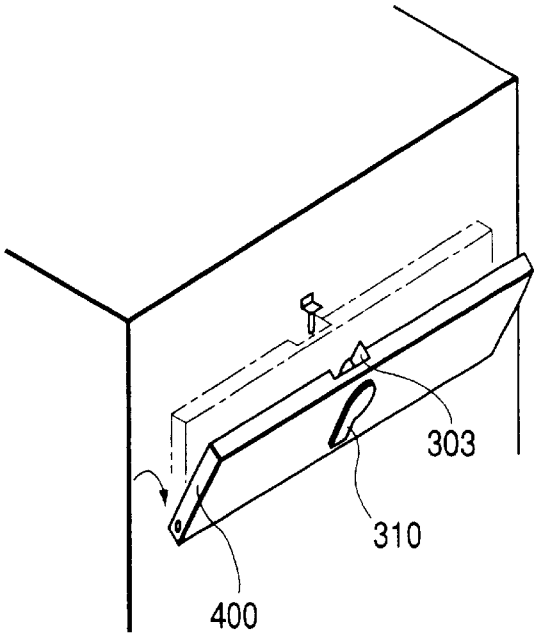
FIGS. 10A, 10B and 10C illustrate the opening and closing stages of the centering plate.
Figure 10B:
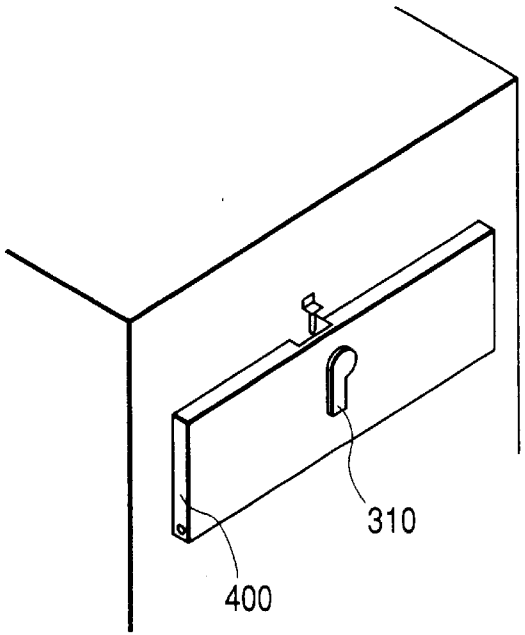

That is, when the handle gear 302 is rotated, the lead cam gear 303 and the eccentric cam gear 301 are rotated and the eccentric can gear 301 moves the came follower aperture 304, whereby the Y determining plate is moved leftwardly (in the minus (–) X direction) relative to the X determining plate. Accordingly, each rotary shaft 12*a* is moved from the aperture portion 121 to the aperture portion 123 of the Y determining plate, and the openable and closable door unit 400 integrally having the centering plate 100 becomes pivotally movable (sequentially shafts from the state of FIG. 10A to the states of FIGS. 10B and 10C) without being interfered with by each rotary shaft 12*a*.

Figure 10A:
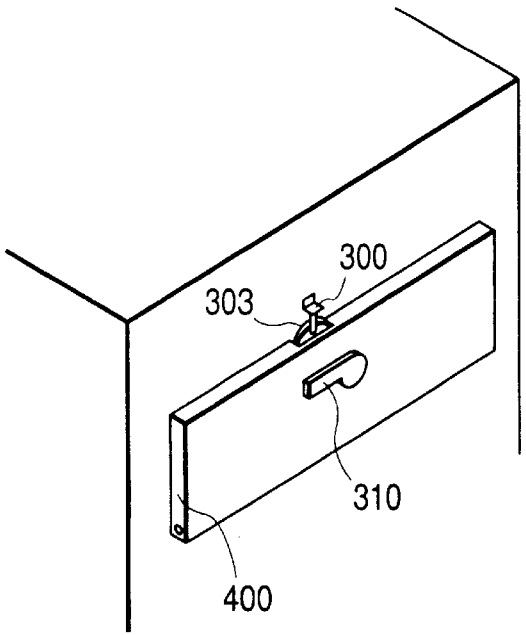

That is, in the state of FIG. 10A (the state before the centering plate 100 is pivotally moved), the lead cam gear 303 is caught by a lead cam receiving pin 300 provided on the main body side of the apparatus, and by adopting such a construction, the pivotal movement of the centering plate 100 cannot be effected unless the lead cam gear 303 is rotated by the aforementioned moving mechanism, and the user can be prevented from damaging each rotary shaft 12*a* and the Y determining plate by mistake. By adopting such a construction, an improvement in usability can be achieved.

Figure 11:
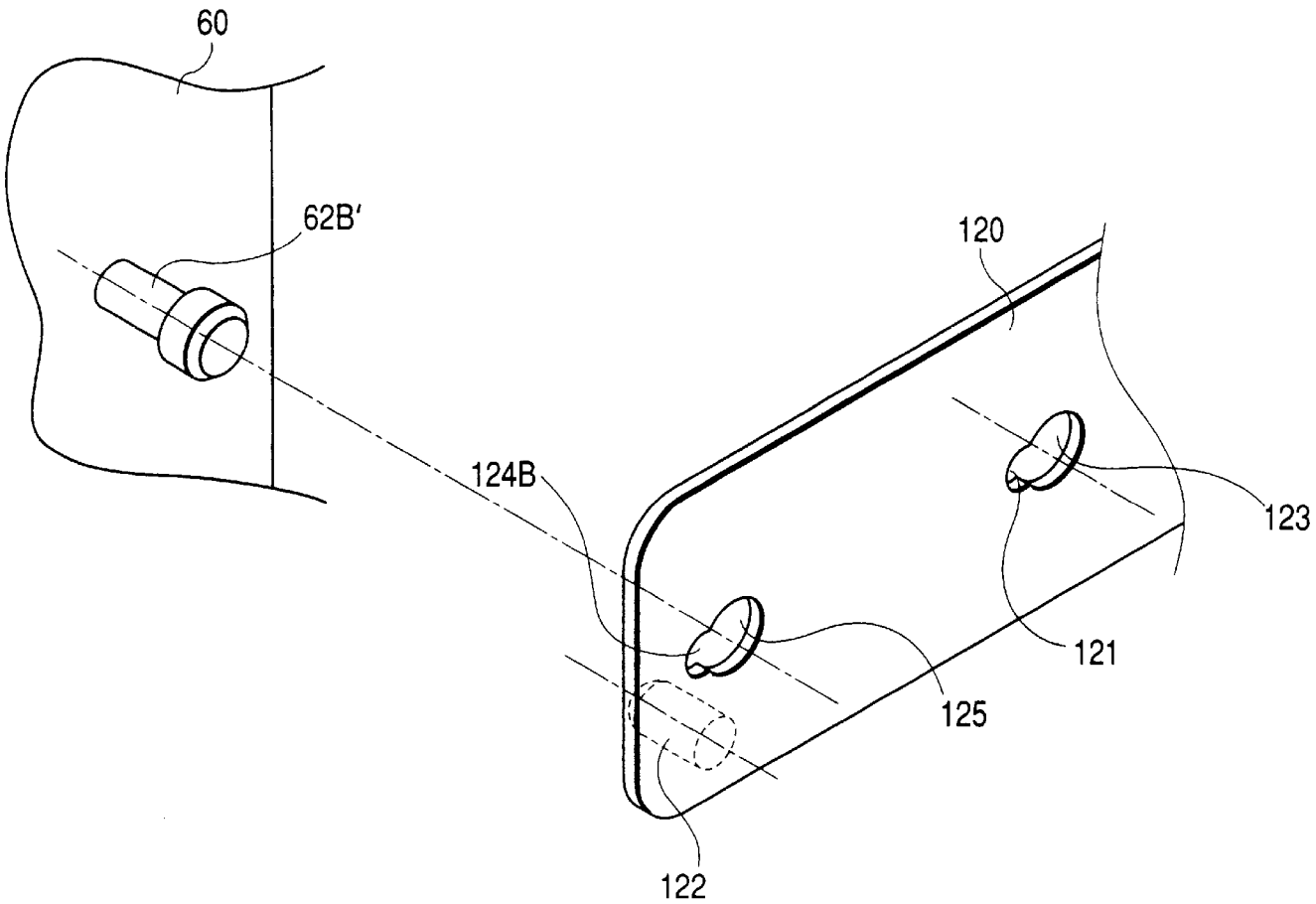
FIG. 11 illustrates a reference pin.
Figure 12A:
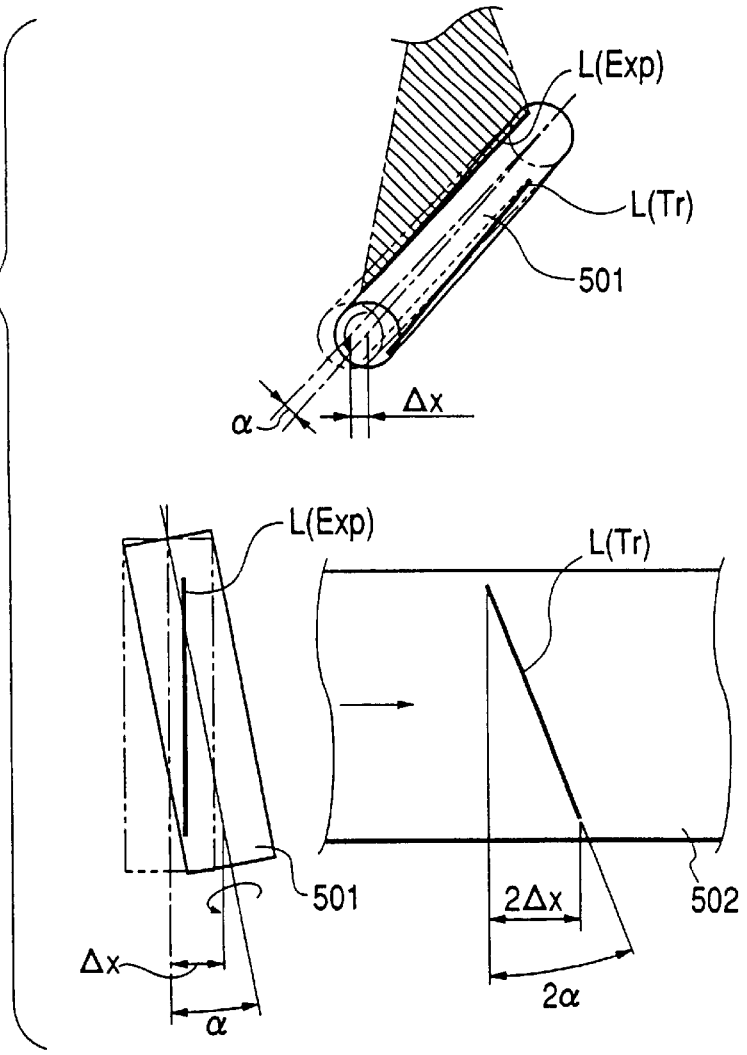
FIG. 12A, consisting of FIGS. 12A1 and 12A2 and 12B, consisting of FIGS. 12B1 and 12B2) are a typical perspective view and a plan view, respectively, illustrating color misregistration.
Figure 12B:
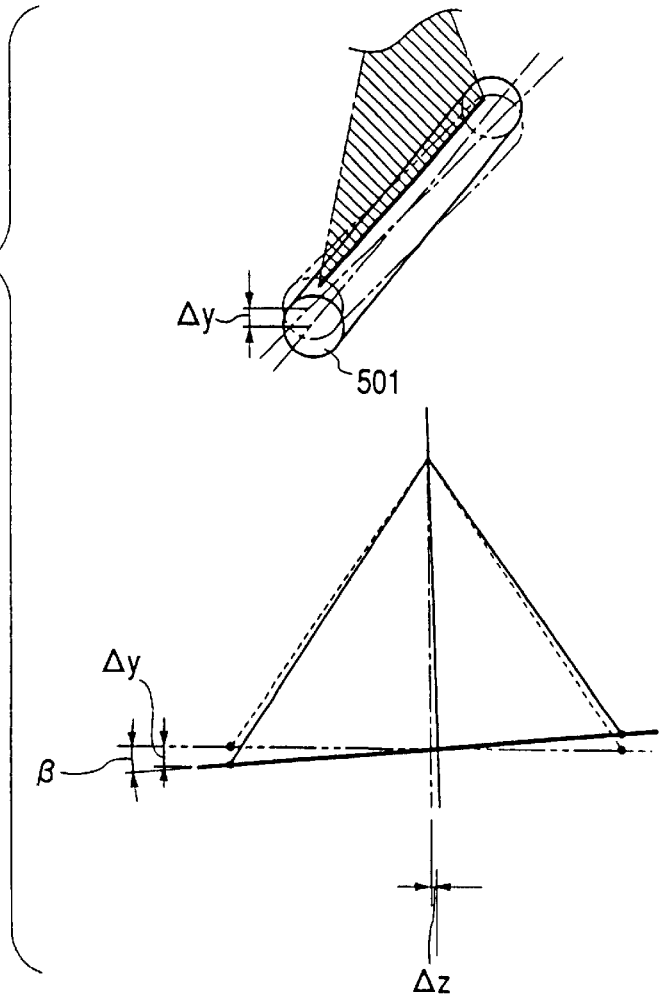
Figure 13:
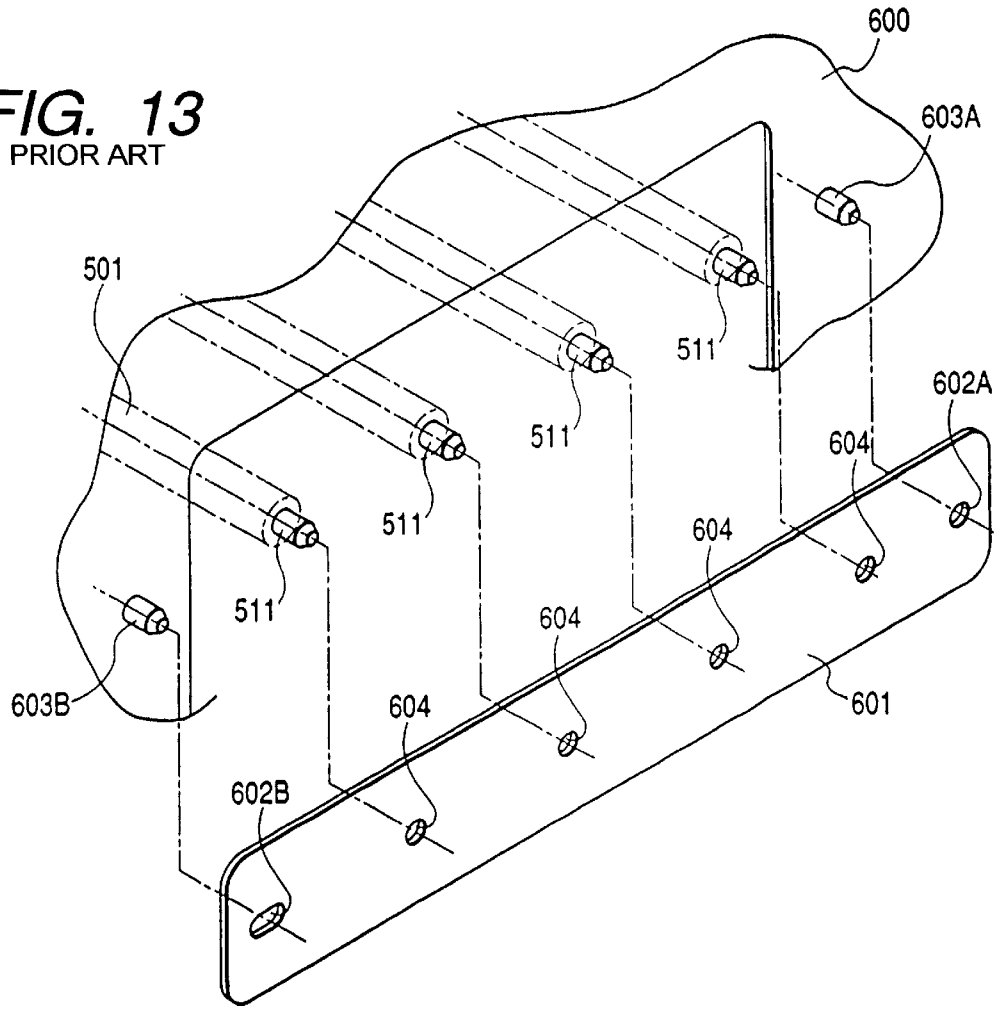
FIG. 13 PRIOR ART
FIG. 13 is a typical perspective view showing the positioning of a photosensitive drum according to the conventional art.

Also, the reference pin 62B provided on the side plate 60 of the main body may be constructed so as to assume a shape like that of a reference pin 62B' as shown in FIG. 11 wherein the diameter of the tip end is made large. That is, design may be made such that the pivotal movement of the centering plate 100 cannot be effected unless the Y determining plate is moved by the above-mentioned moving mechanism from a state in which the reference pin 62B' is engaged with the aperture portion 124B of the Y determining plate to a state in which it is freely supported by the widened portion 125.

Also, while in the first and second embodiments, description has been made of an example in which the X determining plate is disposed so as to be nearer to the main body of the image forming apparatus than the Y determining plate, this is not restrictive, but design may be made such that the Y determining plate is nearer to the main body of the image forming apparatus.

If the X determining plate is disposed inside as described in the present embodiment, when the operation of closing the centering plate 100 is performed, it is regulated (sandwiched) earlier by the X determining plate nearer to the rotary shaft 12*a* of each photosensitive drum, that is, is regulated (positioned) earlier in the X direction. As the centering plate is further closed, each rotary shaft 12*a* extends through the widened portion 123 of the Y determining plate, and moves the Y determing plate in the X direction relative to the X determining plate and is thereby sandwiched. By adopting such a construction, the X direction is regulated earlier and therefore, the size of the widened portion 123 in the X direction and the amount of movement of the Y determining plate in the X direction can be minimized as required. That is, the bulkiness of the centering plate is not caused and each widened portion 123 can be made as small as possible and therefore, the reduction in the strength of the Y determing plate by each widened portion 123 can be made small.

On the other hand, when the X determining plate is disposed outside, that is, the Y determining plate is disposed inside, the sandwiching of each rotary shaft 12*a* in the Y direction can be done in a portion nearer to each photosensitive drum (each rotary shaft) and therefore, positional deviation attributable to the deformation of each rotary shaft 12*a* can be made as small as possible.

Also, while in the first and second embodiments, description has been made of an example in which each rotary shaft 12*a* is fitted to and rotated with the photosensitive drum, this is not restrictive, but design may be made such that each rotary shaft 12*a* is an unrotatable fixed shaft and the photosensitive drum is rotatably supported by this fixed shaft. For example, the apparatus may be of a construction in which the opposite end portions of each photosensitive drum contain therein a resin material of good slidability or ball bearings and the above-mentioned fixed shaft is supported by the centering plate 100 and the positions of the fixed shaft in the X and Y directions are regulated.

Other Embodiments

Figure 6:
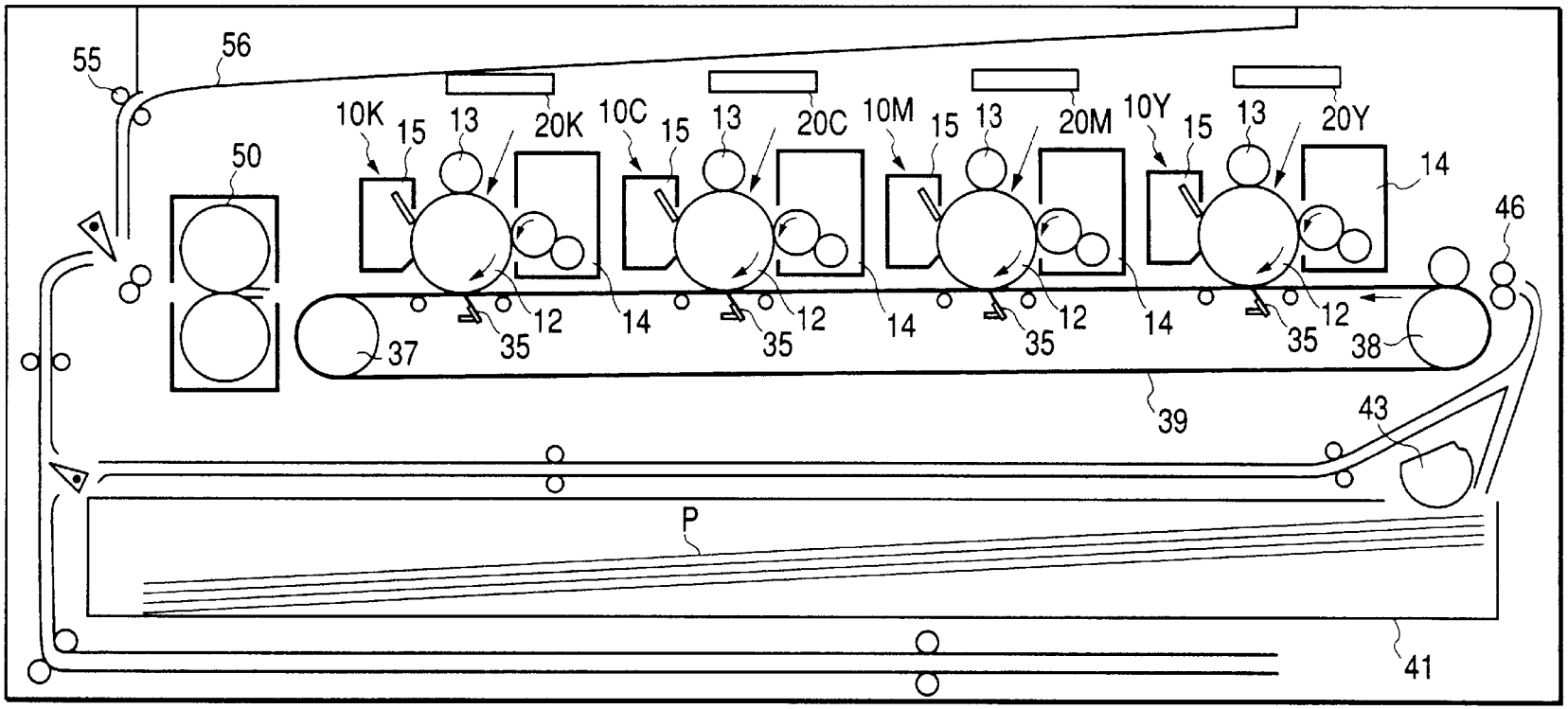
FIG. 6 illustrates another color image forming apparatus.

While in the aforedescribed embodiments, description has been made of an example in which the present invention is applied to an image forming apparatus in which images formed on the photosensitive drums 12 are sequentially superimposed and primary-transferred to the intermediate transfer belt, and the images sequentially superimposed and primary-transferred to the intermediate transfer belt are collectively secondary-transferred to the recording material P, the present invention is not restricted thereto. For example, as shown in FIG. 6, the present invention can be applied to a construction for supporting and positioning the rotary shaft of each photosensitive drum in an imaging forming apparatus of a construction in which a recording material P as a transfer medium selectively supplied from a cassette 41 or the like is carried on and conveyed by a recording material conveying belt 39 which is a recording material carrying member passed over rollers 37 and 38, and toner images of respective colors formed on the photosensitive drums 12 by process cartridges 10Y, 10M, 10C and 10K are sequentially superimposed and transferred to the recording material P carried on the recording material conveying belt 39, whereby an effect similar to that of the aforedescribed embodiments can be expected. In FIG. 6, members functionally similar to those in the aforedescribed embodiments are given the same reference numerals and need not be described in detail.

Also, while in the aforedescribed embodiments, a process cartridge integrally having a photosensitive drum and charging means, developing means and cleaning means as process means acting on the photosensitive drum has been shown as the process cartridge detachably mountable to the image forming apparatus, this is not restrictive, but the process cartridge may be a process cartridge integrally having, for example, one of the aforementioned process means.

Further, while in the aforedescribed embodiments, a construction in which the process cartridge comprising a photosensitive drum, etc. is detachably mountable to the image forming apparatus has been shown by way of example, this is not restrictive, but the apparatus may be an apparatus in which for example, each constituent member such as the photosensitive drum is constructed as a detachably mountable unit.

Also, while in the aforedescribed embodiments, a printer has been shown as the image forming apparatus, the present invention is not restricted thereto, but the image forming apparatus may be, for example, other image forming apparatus such as a copier or a facsimile apparatus, and the present invention can be applied to such image forming apparatus to thereby obtain a similar effect.

Also, while in the aforedescribed embodiments, the process cartridges have been shown as consisting of four colors, i.e., Y, M, C and K, this is not restrictive, but for example, it is possible to form a color image by only three colors, and in that case, one set of process cartridge may be decreased.

As described above, according to the present invention, even if the position of each of the rotary shafts of a first image bearing member and a second image bearing member is adjusted (moved) in a first direction, it is possible to exercise no influence upon the position of each rotary shaft in a second direction. Accordingly, the first image bearing member and the second image bearing member (or a first unit and a second unit) can be easily and accurately mounted on the main body of the apparatus. Further, the time equired for the work of assembling the first image bearing member and the second image bearing member to the apparatus and the work for interchange can be shortened. Also, the mounting accuracy is ensured by the dimensional accuracy of parts equal to that in the prior art and therefore, an increase in cost resulting from an improvement in the accuracy of parts is not caused.

What is claimed is:

1. An image forming apparatus comprising:

a first image bearing member for bearing an image thereon;

a second image bearing member for bearing an image thereon;

the images on said first image bearing member and said second image bearing member being sequentially superimposed and transferred to a transfer medium; and supporting means for supporting each of rotary shafts of said first image bearing member and said second image bearing member, wherein said supporting means is provided with a first supporting member for supporting each of said rotary shafts for movement in a first direction and for regulating a position of each of said rotary shafts in a second direction substantially orthogonal to the first direction, and a second supporting member for supporting each of said rotary shafts for movement in the second direction and for regulating a position of each of said rotary shafts in the first direction.

2. An image forming apparatus according to claim 1, wherein the first direction is a direction of movement of the transfer medium.

3. An image forming apparatus according to claim 2, further comprising first exposing means for exposing said first image bearing member after being charged, and second exposing means for exposing said second image bearing member after being charged, wherein each of said rotary shafts is moved in the second direction to adjust a distance between each of said exposing means and each of said image bearing members.

4. An image forming apparatus according to claim 2, further comprising first exposing means for exposing said first image bearing member after being charged, and second exposing means for exposing said second image bearing member after being charged, wherein each of said rotary shafts is moved in the first direction to adjust a direction of each of said rotary shafts relative to a scanning direction of each of said exposing means.

5. An image forming apparatus according to claim 1, wherein said first supporting member is provided with an aperture for supporting each of said rotary shafts for movement in the first direction.

6. An image forming apparatus according to claim 1, wherein said first supporting member is provided with an aperture in which an aperture for supporting each of said rotary shafts for movement in the first direction and an aperture for supporting each of said rotary shafts for movement in the second direction communicate with each other.

7. An image forming apparatus according to claim 1, further comprising adjusting means for independently adjusting a position of each of said rotary shafts in the second direction, wherein said adjusting means is provided on said first supporting member.

8. An image forming apparatus according to claim 1, wherein said second supporting member is provided with an aperture for supporting each of said rotary shafts for movement in the second direction.

9. An image forming apparatus according to claim 1, wherein said first supporting member, together with said second supporting member, is positioned in a positioning portion of a main body of said image forming apparatus.

10. An image forming apparatus according to claim 1, wherein said first supporting member and said second supporting member, respectively, support one end of each of said rotary shafts.

11. An image forming apparatus according to claim 10, wherein said supporting member is provided with a supporting member for supporting the other end of each of said rotary shafts.

12. An image forming apparatus according to claim 1, further comprising a first unit provided with said first image bearing member, and a second unit provided with said second image bearing member, said first unit and said second unit being detachably mountable to a main body of said image forming apparatus.

13. An image forming apparatus according to claim 12, wherein said first supporting member is provided with an aperture in which a first aperture for supporting each of said rotary shafts for movement in the first direction and a second aperture for supporting each of said rotary shafts for movement in the second direction communicate with each other.

14. An image forming apparatus according to claim 13, wherein said second supporting member is provided with an aperture for supporting each of said rotary shafts for movement in the second direction.

15. An image forming apparatus according to claim 14, further comprising a third unit provided with said first supporting member and said second supporting member, said third unit being pivotally movable about a center of pivotal movement to form a space for mounting and dismounting said first unit and said second unit to the main body of said image forming apparatus.

16. An image forming apparatus according to claim 15, further comprising regulating means for regulating the pivotal movement of said third unit until said first supporting member is moved in the first direction so that each of said rotary shafts may be supported by each of said second apertures.

17. An image forming apparatus according to claim 16, wherein said regulating means moves said first supporting member in the first direction so that each of said rotary shafts may be supported by each of said second apertures.

18. An image forming apparatus according to claim 15, wherein said center of pivotal movement is a lower end portion of said third unit.

19. An image forming apparatus according to claim 15, wherein said center of pivotal movement is a side end portion of said third unit.

20. An image forming apparatus according to claim 1, wherein the images on the transfer medium sequentially transferred from said first image bearing member and said second image bearing member are transferred to a recording material.

21. An image forming apparatus according to claim 1, further comprising conveying means for bearing the transfer medium thereon and conveying the transfer medium, wherein the images on said first image bearing member and said second image bearing member are sequentially transferred to the transfer medium borne on said conveying means.

22. An image forming apparatus according to claim 1, wherein said first supporting member and said second supporting member support each of said rotary shafts by means of a bearing for receiving each of said rotary shafts.

23. An image forming apparatus comprising:

a first unit provided with a first image bearing member for bearing an image thereon;

a second unit provided with a second image bearing member for bearing an image thereon;

the images on said first image bearing member and said second image bearing member being sequentially superimposed and transferred to a transfer medium; and supporting means for supporting protruding portions provided on said first unit and said second unit, wherein said supporting means is provided with a first supporting member for supporting each of said protruding portions for movement in a first direction and for regulating positions of said protruding portions in a second direction substantially orthogonal to the first direction, and a second supporting member for supporting each of said protruding portions for movement in the second direction and for regulating the positions of said protruding portions in the first direction.

24. An image forming apparatus according to claim 23, wherein the first direction is a moving direction of the transfer medium.

25. An image forming apparatus according to claim 24, further comprising first exposing means for exposing said first image bearing member after being charged, and second exposing means for exposing said second image bearing member after being charged, wherein said protruding portions are moved in the second direction to adjust a distance between each of said exposing means and each of said image bearing members.

26. An image forming apparatus according to claim 24, further comprising first exposing means for exposing said first image bearing member after being charged, and second exposing means for exposing said second image bearing member after being charged, wherein each of said protruding portions is moved in the first direction to regulate a direction of each of said protruding portions relative to a scanning direction of each of said exposing means.

27. An image forming apparatus according to claim 23, wherein said first supporting member is provided with an aperture for supporting each of said protruding portions for movement in the first direction.

28. An image forming apparatus according to claim 23, wherein said first supporting member is provided with an aperture in which an aperture for supporting each of said protruding portions for movement in the first direction and an aperture for supporting each of said protruding portions for movement in the second direction communicate with each other.

29. An image forming apparatus according to claim 23, further comprising adjusting means for independently adjusting positions of said protruding portions in the second direction, wherein said adjusting means is provided on said first supporting member.

30. An image forming apparatus according to claim 23, wherein said second supporting member is provided with an aperture for supporting each of said protruding portions for movement in the second direction.

31. An image forming apparatus according to claim 23, wherein said second supporting member is provided with apertures longer in the second direction than said protruding portions, and said apertures support said protruding portions.

32. An image forming apparatus according to claim 23, wherein said first supporting member, together with said second supporting member, is positioned in a positioning portion of a main body of said image forming apparatus.

33. An image forming apparatus according to claim 23, wherein said first supporting member and said second supporting member support each of said protruding portions provided on one end of each of said first unit and said second unit.

34. An image forming apparatus according to claim 33, wherein said supporting means is provided with a supporting member for supporting each of protruding portions provided on the other ends of said first unit and said second unit.

35. An image forming apparatus according to claim 33, wherein said first unit and said second unit are detachably mountable to a main body of said image forming apparatus.

36. An image forming apparatus according to claim 35, wherein said first supporting member is provided with an aperture in which a first aperture for supporting each of said protruding portions for movement in the first direction and a second aperture for supporting each of said protruding portions for movement in the second direction communicate with each other.

37. An image forming apparatus according to claim 36, wherein said second supporting member is provided with an aperture for supporting each of said protruding portions for movement in the second direction.

38. An image forming apparatus according to claim 37, further comprising a third unit provided with said first supporting member and said second supporting member, said third unit being pivotally movable about a center of pivotal movement to form a space for mounting and dismounting said first unit and said second unit from the main body of said image forming apparatus.

39. An image forming apparatus according to claim 38, further comprising regulating means for regulating the pivotal movement of said third unit until said first supporting member is moved in the first direction so that each of said protruding portions may be supported by each of said second apertures.

40. An image forming apparatus according to claim 39, wherein said regulating means moves said first supporting member in the first direction so that each of said protruding portions may be supported by each of said second apertures.

41. An image forming apparatus according to claim 38, wherein the center of pivotal movement is a lower end portion of said third unit.

42. An image forming apparatus according to claim 38, wherein the center of pivotal movement is a side end portion of said third unit.

43. An image forming apparatus according to claim 23, wherein the images on said transfer medium sequentially transferred from said first image bearing member and said second image bearing member are transferred to a recording material.

44. An image forming apparatus according to claim 23, further comprising conveying means for bearing the transfer medium thereon and conveying the transfer medium, wherein the images on said first image bearing member and said second image bearing member are sequentially transferred to the transfer medium borne on said conveying means.

45. An image forming apparatus according to claim 23, wherein each of said protruding portions is provided near a position of a center of gravity of each of said first unit and said second unit.

46. An image forming apparatus according to claim 45, wherein each of said protruding portions is provided near a position of a rotary shaft of each of said first image bearing member and said second image bearing member.

* * * * *

UNITED STATES PATENT AND TRADEMARK OFFICE

CERTIFICATE OF CORRECTION

PATENT NO. : 6,477,346 B1
DATED : November 5, 2002
INVENTOR(S) : Takashi Yahagi

It is certified that error appears in the above-identified patent and that said Letters Patent is hereby corrected as shown below:

Column 1,
Line 40, “a” should read -- α --.

Column 3,
Line 20, “consisting” should read -- (consisting --.

Column 4,
Line 31, “i s” should read -- is --.

Column 5,
Line 62, “the-diameter” should read -- the diameter --.

Column 8,
Line 34, “move” should read -- moved --.

Column 10,
Line 52, “fluctuated.” should read -- fluctuate. --.

Column 16,
Line 29, “claim 33,” should read -- claim 23, --.

Signed and Sealed this

Twenty-ninth Day of July, 2003

JAMES E. ROGAN
*Director of the United States Patent and Trademark Office*